United States Patent [19]

Rünzi

[11] Patent Number: 4,565,360

[45] Date of Patent: Jan. 21, 1986

[54] SEPARABLE SINGLE-SHEET FEEDING APPARATUS FOR OFFICE MACHINES

[76] Inventor: Kurt Rünzi, Küsnachterstrasse 59, CH-8126 Zumikon, Switzerland

[21] Appl. No.: 575,183

[22] Filed: Jan. 30, 1984

[30] Foreign Application Priority Data

Nov. 15, 1983 [CH] Switzerland ..... 6129/83

[51] Int. Cl.[4] ..... B65H 5/06

[52] U.S. Cl. ..... 271/4; 271/116; 271/127; 271/162; 271/171; 400/625; 400/629

[58] Field of Search ..... 271/109, 127, 145, 162, 271/171, 213, 223, 4, 114, 116; 400/624, 625, 629

[56] References Cited

U.S. PATENT DOCUMENTS 4,326,815 4/1982 Kapp ..... 271/4

4,371,276 2/1983 Mitrovich ..... 271/213 X

*Primary Examiner*—Richard A. Schacher

*Attorney, Agent, or Firm*—Frishauf, Holtz, Goodman & Woodward

[57] ABSTRACT

To permit attachment of a single-sheet feeding and separating unit to various types and variously dimensioned office machines of different manufacturers, the sheet-feeding and guiding unit (1) is releasably attached (11, 17; 23) to a connecting frame (2) which is made specifically adapted to match a specific type model or manufacture of office machine (3). The frame (2) has a positive engagement latch (FIG. 4: 44, 50) for engagement with the office machine, fitting around the platen shaft (45) thereof, and carries rotation-transmitting gears (29, 28, 30), positioned to match a standard sheet-feeding and separating unit (1) which, then, can be made in one form of manufacture, carrying all the apparatus necessary for sheet-feeding, the frame merely matching the size and shape of the specific office machine to the sheet-feeding and separating unit to permit mass production of the sheet-feeding and separating unit, and a complex internal arrangement thereof, without essential changes, and locating all matching and adapting elements to match the mass-produced sheet-feeding and separating units to specific office machines by the adapter frame.

11 Claims, 6 Drawing Figures

1
2
5
6
7
8
10
11
12
15
16
17
18
19
21
24
24'
26
28
29
30
32
36
38
40
41
44
46
47
48
50
A

SEPARABLE SINGLE-SHEET FEEDING APPARATUS FOR OFFICE MACHINES

Reference to related applications and patents by the inventor hereof, the disclosure of which is hereby incorporated by reference:

U.S. Ser. No. 536,862, filed Sept. 29, 1983, Runzi;
U.S. Ser. No. 536,863, filed Sept. 29, 1983, Runzi:
U.S. Ser. No. 559,901, filed Dec. 12, 1983, Runzi.
U.S. Pat. No. 3,583,696, Runzi.

The present invention relates to single-sheet feeding apparatus for office machines, such as typewriters, output printers of word processors, and the like, and more particularly to the type of apparatus described in the referenced applications Ser. No. 536,862, filed Sept. 29, 1983, and Ser. No. 536,863, filed Sept. 29, 1983, both by the inventor hereof, the disclosure of which is hereby incorporated by reference.

BACKGROUND

Various types of single-sheet feeding apparatus to feed, automatically, single sheets to typewriters, printers, and other office machines, have been proposed. For many installations, it is desirable to be able to selectively associate the single-sheet feeder with an already existing apparatus, so that the feed of the single sheets can be controlled by machine operation of the office machine, without, however, interfering with manual feed of sheets, or requiring purchase of a new, or different apparatus capable of automatic sheet insertion. Different manufacturers and different types of office machines requiring single sheets have different dimensions and different arrangement of capabilities. This makes it difficult to provide an attachment element to such office machines of various manufacturers and to control sheet feeding from the different types of office machines.

THE INVENTION

It is an object to so construct a single sheet-feeding apparatus that it is suitable as an attachment to various types of offices machines, and made by various manufacturers, utilizing sheets of various dimensions, or feeding sheets of given dimensions to machines capable of handling sheets of many dimensions, for example substantially wider than the sheets being supplied thereto by the apparatus.

Briefly, a sheet guiding and separating unit, which may use some of the features described in the referenced applications by the inventor hereof, is combined with an adapter frame which couples the sheet-feeding unit as such to the office machine. The adapter frame includes a gear which is coupled to a shaft which, in turn, is positioned for engagement with a platen gear, associated with the sheet platen of the office machine. The adapter frame further includes one or more coupling pinions for coupling rotary motion received from the platen of the office machine to the sheet-feeding unit as such.

The intermediate or adapter frame can be so constructed that it is adaptable to be coupled to various types of machines; the adapter frame is an inexpensive element which can readily be made for particularly matching the dimensions and structural arrangements of various types and manufacturing origins of office machines, and transferring motion derived from these different and various types of office machines to one standard sheet-feeding unit which contains the majority of operating parts,and the manufacture of which, inherently, is much more expensive than that of the adapter frame. Consequently, matching of the overall structure to any one specific model or manufacture of office machine requires merely matching of different adapter frames to the office machine, the output from the adapter frame being standardized to fit a sheet-feeding apparatus which can be in the form of one model, or a limited number of models, and suitable for coupling to all of the respective adapter frames.

The adapter frame is so constructed that it can receive the motion-transmitting elements which transfer movement from the writing platen or impression platen or sheet guiding platen or a typewriter or output printer to the sheet-feeding apparatus to provide for synchronized operation of sheet feeding and, eventually, printing on the sheets which are being fed. The adapter frame can be constructed as an open frame structure, or in form of an adapter bracket fitting on the typewriter, printer or the like, and providing for motion transfer of platen operation to the sheet-feeding unit as such.

DRAWINGS

Figures 2, 3, 4:
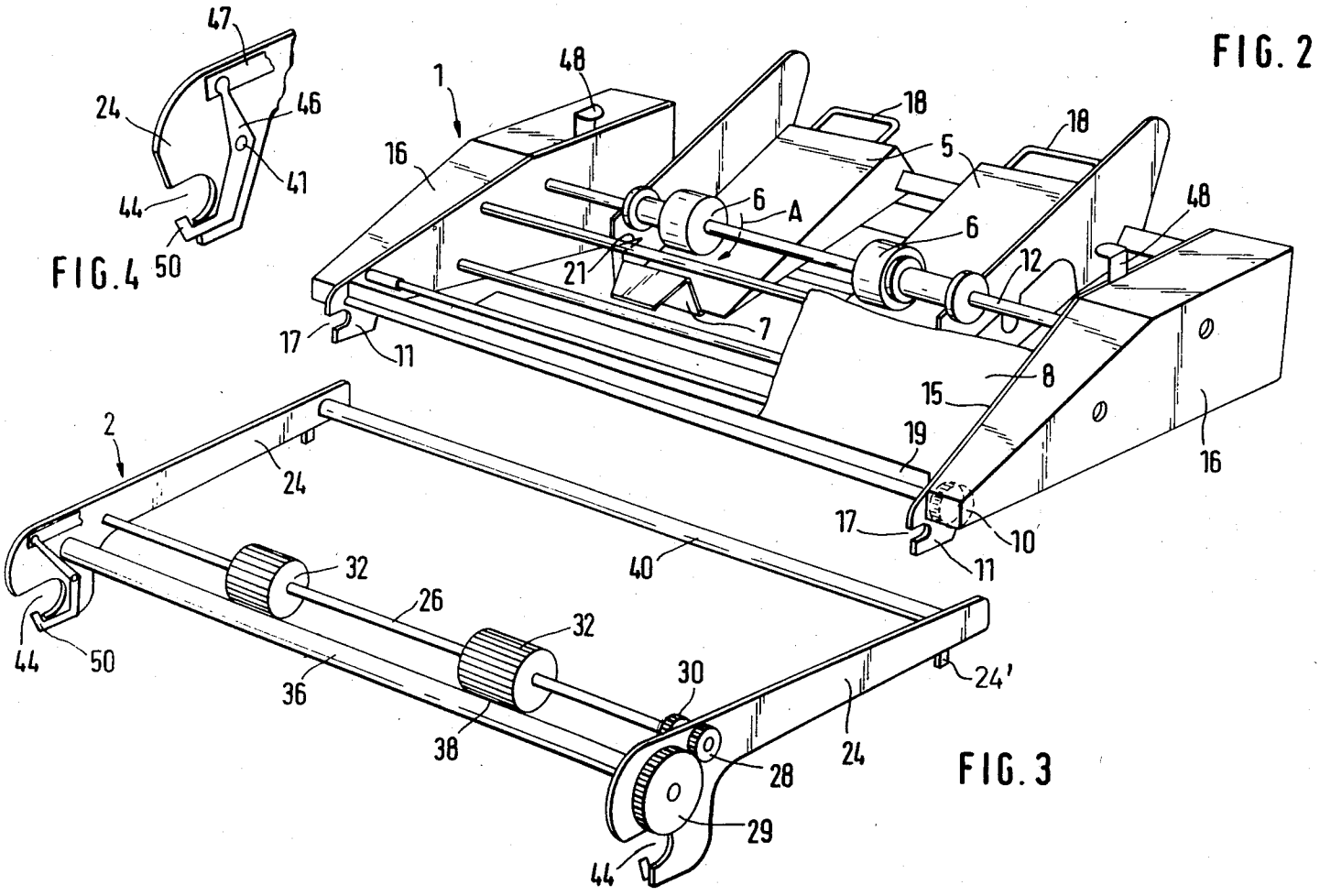
FIG. 2 is a perspective unit of the sheet-feeding unit in greater detail.
FIG. 3 is a perspective view of the adapter frame.
Figure 3A:
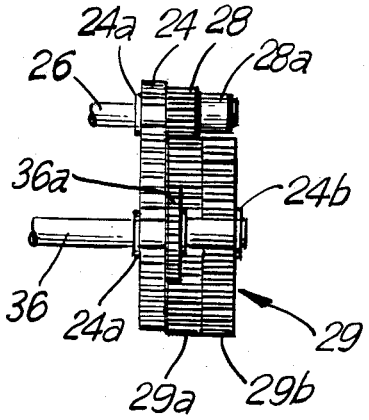

FIG. 3*a* is a detail view of a drive arrangement for a drive shaft;

FIG. 4 is a detail of a holding and locking arrangement; and

Figure 5:
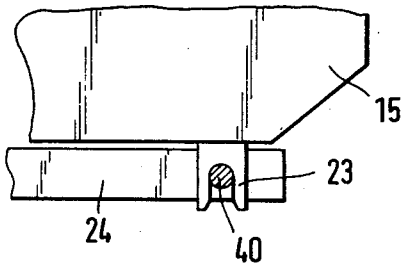

FIG. 5 is a further detail of an attachment arrangement to secure the sheet-feeding unit to the adapter frame.

Figure 1:
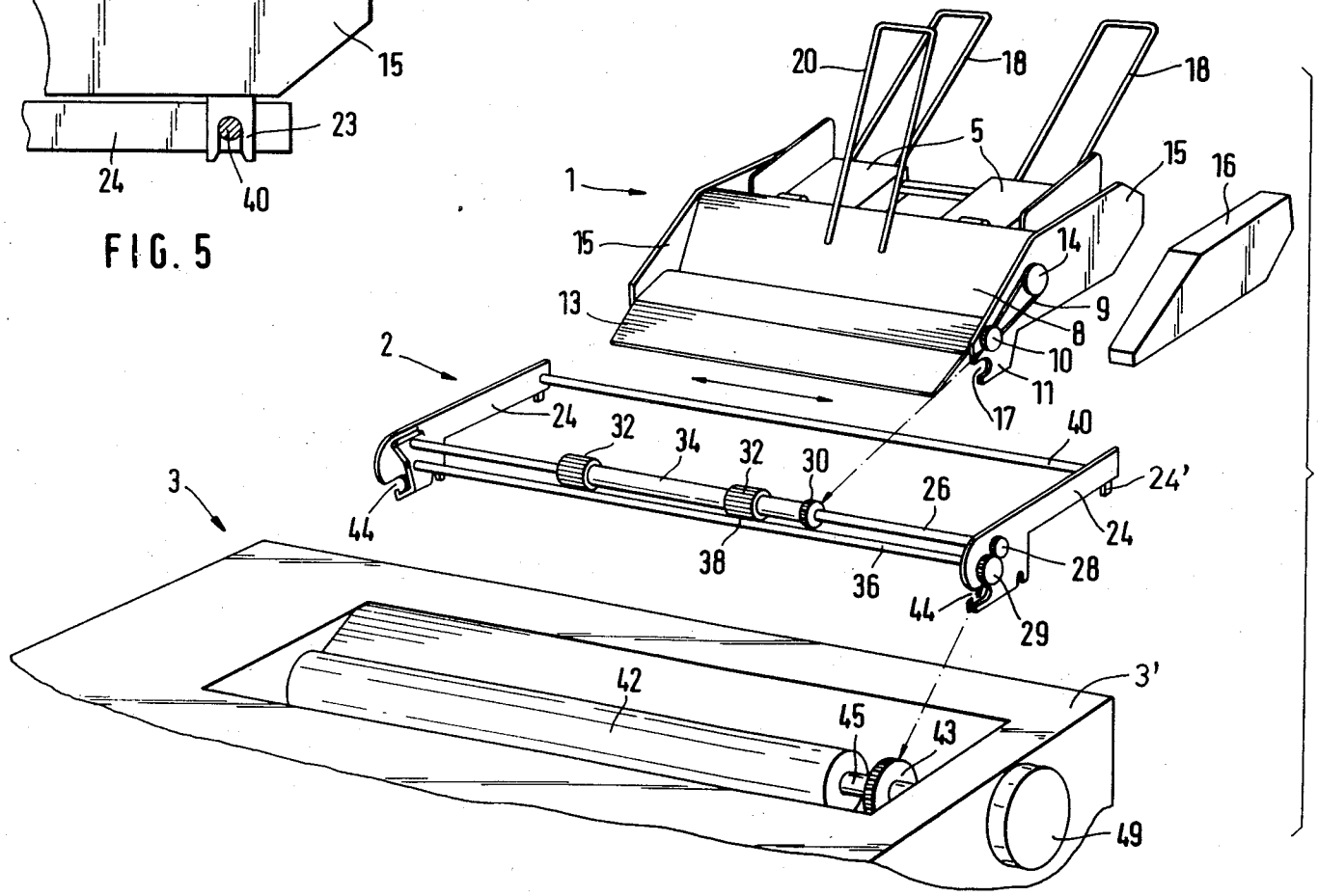
FIG. 1 is an exploded perspective view of an office machine, a sheet feeding unit, and an adapter frame.

A single sheet-feeding unit 1— see FIGS. 1, 2— has all the necessary structural and transport devices in order to feed single sheets to the platen of a typewriter, an output printer, for example from a word processor, or the like. The structure, and sheet-feeding mechanism itself, is described in detail in the referenced applications by the inventor hereof, U.S. Ser. Nos. 536,862 and 536,863. The present invention is directed to the connection of such a unit with the printer, typewriter, or similar office equipment. Only so much of that unit will be described, therefore, as is necessary for an understanding of the present invention.

A stack of sheets which, for example, may have letterheads or other data pre-printed thereon, is placed on pivotably positioned support plates 5, to fit with the leading edge of the sheet against abutments 7. The uppermost sheet of the stack is engaged by two rotatable separating rollers 6, which are positioned on a common drive shaft 12. The drive shaft 12 is driven by a gear 14 (FIG. 1) which, in turn, is positively driven by a gear belt 9, engaged by a gear 10, or a gear coupled thereto. The drive shaft 12 is so driven through a transmission which includes a one-way or free-wheeling clutch. Upon rotation of the gear 12, the rollers 6 are positively driven to feed the topmost sheet from the stack of sheets; upon termination of feed drive, however, the rollers can continue to roll freely in the feeding direction, to roll along with the sheet. The sheet, thus, can be positively fed for a distance only sufficient to permit it to be grasped between the platen 42 and the customary platen pressure roller (not shown) of, for example, a typewriter, the rollers 6 then running freely as the sheet is pulled into printing position by the typewriter or printer 3. A subsequent sheet can then be fed spaced from the first sheet upon subsequent power feed or power drive of the separating rollers 6.

In addition to the rollers 6, separation of sheets is insured by separating corners 21 which are so arranged that, upon rotation of the separating rollers 6 in the direction of the arrow A (FIG. 2), the uppermost sheet is slightly bowed and jumps over the corners 21, thereby preventing double feed of sheets. Other, and additional systems to insure single-sheet feeding only, such as counter-rotating rollers, may also be used—see U.S. application Ser. No. 559,901, filed Dec. 12, 1983, by the inventor hereof. The rear portions of the sheets of the stack are supported by U-shaped holding bails 18. To provide a compact unit, the support plates 5 are formed with suitable openings to permit the bails 18 to be slid behind the plates 5. FIG. 2 shows the bails 18 in storage position.

The lateral drive elements 9, 10, 14 for a topmost sheet 8 (FIGS. 1, 2) are secured to lateral support plates 15 (FIG. 1) and protected against dirt, contamination, dust and the like by cover caps 16. The side plates 15 have forwardly projecting connecting flaps 11, projecting downwardly. The connecting flaps 11 are formed with a concave groove or notch 11 to form a holding hook 17. In assembled position, the holding hook 17 is engaged with a cross rod or shaft 36 of the intermediate or connecting frame 2.

In accordance with the present invention, a connecting frame 2, usually wider than the operating unit 1, is, preferably releasably, secured to the office machine 3. The connecting frame 2, preferably, is matched to the width of the machine 3.

The connecting frame 2 includes two lateral side plates 24, spaced and held in position by a rear spacing rod 40 and a forward spacing rod 36. The spacing rods 36, 40, for matching to existing machines, may be made as two telescoping elements; since the frame 2, however, is the only element in the overall assembly which needs to be matched to a specific machine, it is an easy matter to build the frames 2 of standard components and merely cut the requisite cross elements 36, 40 and shaft 26, as will appear, to the proper length for any existing machine, so that the frame 2 is the matching unit which matches a specific type and size or model of an office machine to a standard sheet-feeding unit 1.

In addition to the spacing rods 36, 40, a shaft 26 connects the two lateral plates 24. Shaft 26 is rotatably journalled in the side plates 24. It carries ribbed paper feed rollers 32. The paper feed rollers 32 can be individually slidably located on the shaft 26, or can be connected by a connecting sleeve 34 (see FIG. 1) so that they will slide conjointly. A pinion 30 is located on the shaft 26, and positioned with respect to a center line of the frame 2 such that it will be engaged by the gear 10 of the unit 1. The pinion 30 is rotatably secured to the shaft 26. Shaft 26 extends beyond the right side of the end plate 24—with reference to FIG. 3—and is engaged with a gear 29 of greater diameter than that of pinion 28.

The rear portion of the side plates 15 is formed with depending flaps 23 which have an open U-shaped notch, with a slight constriction towards the opening, and an inner shape and dimension to fit over the cross rod 40. To engage the unit 1 with unit 2, the forward hook-shaped notches 17 of the engagement end 11 of unit 1 are fitted against and partly over shaft 36 and the depending flaps 23 are snapped over the rear connecting rod 40 to form a securely fitting, but separable attachment. The rear connection is shown in detail in FIG. 5, and, for example, projects from the side elements 16. Due to the springy engagement of the flaps 23 over the rod 40, the unit 1 can be lifted off frame 2, for example for shipment, and a standard unit 1, for example of a given size, can be used with frames 2 of various sizes, the frames 2 then being matched to the size, model and type of machine 3.

The frame 2, in accordance with a feature of the invention, is individually engageable with the machine 3. The forward part of the side plates 24 is formed with a generally U-shaped notch 44—see FIG. 4. The notch 44 is specifically matched to fit over the shaft 45 of the platen 42 of the printer or typewriter 3. A lever 46, journalled on a pivot pin 41, is coupled to an operating rod 47 which is pivotably held in unit 1, and coupled, in turn, to an engagement lever 48 (FIG. 2). The coupling between rod 47 and the lever 11 is, for example, by a ball-and-socket connection as shown schematically in FIG. 4, and, for frames 2 which are substantially wider than the units 1, may include a lateral connecting link—not shown. Alternatively, the latch lever 46 can be operated, manually, from the outside of the left-hand plate 24—with despect to FIG. 3. The hook 50, for example spring-loaded (not shown) in accordance with any suitable construction, for example by a spiral spring, effects secure, yet releasable connection of the frame 2 with the office machine unit 3. When engaged with an office machine, a coupling gear 43 (FIG. 1) usually already present on the office machine and coupled to an operating mechanism therein, will engage the gear 29 on the frame 2. Rotary movement of the platen 42, controlled by the gear 43, thus is transmitted to the gear 29, with positive drive connection and without slip, which rotary movement is then further transmitted to the gears 28, 30 of the frame 2, and hence from the pinion gear 30 to gear 10 of the unit 1, which then will cause the intermittent drive of the topmost sheet of the stack 5, as explained in the referenced applications. The platen 49 may, of course, be also manually rotated, as shown by the schematically indicated manual platen control knob 49.

OPERATION

A stack of paper sheets is located on the holding plates 5. The unit 3 is started and its operating control will cause rotation of the platen 42, and hence of the gear 43, in order to introduce a sheet into the machine 3. The uppermost sheet is, thus, removed from the stack 5 and pulled into the machine 3. The respective separating rollers 6 are rotated, to transport the sheet which is separated from the remaining sheets of the stack by the separating corners 21 and to feed the sheet over a top feed plate 8 into a gap or nip for the topmost sheet. The sheet is deflected downwardly behind the platen by a deflecting plate 13 (FIG. 1), and is gripped in the gripping path between the platen 42 and customarily present pressure rollers within the office machine 3, not shown, and standard in office machine equipment of this type. After the positive feeding rotation of the roller 6, the sheet can slide and run freely beneath the roller 6 which, due to the presence of an overrunning clutch, can overrun to permit free removal of the topmost sheet. The printed information is then applied to the sheet in accordance with the input to the office machine 3—which may be manual, automatic, output of a word-processor, or by other operation. After writing, the sheet is gripped by the rollers 32 (FIG. 3) and, by rotation thereof, is fed on an output stack, located on the top side of the cover sheet and, at the bottom, supported by an output stack corner 19 (FIG. 2). The plate 8 has a U-shaped extension bail 20 to hold the finished sheets in position. The sheet removed from the machine 3 by the platen 42 can be fed with its rear side against the visible or top side of the rollers 32, to be engaged thereby by the weight of the sheet itself. Preferably, the rollers 32 will be formed with a rubber, for example soft or sponge rubber surface, in order to increase friction. This surface may, for example, be formed by a jacket or sleeve surrounding the rollers 32. Alternatively, the sheet can be fed through an output nip 38 (FIG. 3) between the rollers 32 and rod 36 therebeneath. The rod 36, in such an operating system, preferably is rotatably positioned in the frame 24 and connected to a gear wheel engaged by either the pinion 30 or one of the gears 29, 28 in order to effect reverse direction of rotation. The intermediate frame 2, thus, permits not only matching of the width of the unit 1 to various types, sizes, shapes and models of office machine 3 but, additionally, may provide for positive feed of the written-on sheets without requiring any additional transport for the output sheets from the machine.

The frame 2, if necessary, may have an additional function: Some machines have gears 43 which differ from a standard pitch. To accomodate different machines, thus, the gear 29 may be formed as a double-gear, with two sets of gear teeth on the circumference, the gear being releasably located on its connection to the frame 2, and reversible, to permit engagement of any one of the selected gear rings with the gear 43, so that the pitch and circumference of the gear 43 and of the gear 29 are properly matched. Gear 28, then, can be made slidable on the shaft 26 to engage one of the standard gear rings of the gear 29. Of course, replaceable gear elements 29 may also be provided. The rollers 32 are preferably secured to shaft 26 to rotate therewith so that out-feeding movement from the platen 42 is transmitted thereto. During writing by the machine 3 on the sheet, the sheet will thus be removed from the roller 42; upon initial insertion of a new sheet into the machine, the rollers 32 will then feed the preceding sheet on the removal abutment 19, the leading portion of the sheet being supported by the bail 20.

The frame 2 can be constructed in accordance with any desired width, so that it can be easily matched to any particular typewriter, output printer, or the like, regardless of dimension, type, model or manufacture. Only minor changes in the unit 1 may be required to match any specific frame 2. Thus, unit 1 may be constructed in standard dimensions, and matching to particular types of office equipment 3 is effected by the connecting frame 2 which can be easily made and dimensioned to fit any particular type of apparatus, for example by suitable cutting of the opening 44, e.g. by stamping, matching the lever 50, and matching the width of the rods 36, 40 and of shaft 26.

Various changes and modifications may be made, and any features described herein may be used with any of the others, within the scope of the inventive concept.

For example, the lower surface 24' of the side plates 24 of the frame 2 can be so arranged that they fit against a flat top surface 3' of the office machine with which the frame is to be associated. The frame plates 24, thus, can be easily shaped and dimensioned to match various types of office machines, with holes for the respective shafts 36, 40 and 26 being suitably positioned for matching engagement, respectively, of gears 29 and 30 with the platen gear 43 and the drive gear 10 of the separating unit 1.

FIG. 3*a* is a fragmentary detailed view to an enlarged scale showing a drive arrangement for the shaft 36. The shaft 36 is held in position at the inside, like the shaft 26, by a C-ring snapped over a suitable groove therein. The end of the shaft 36 is coupled to a thin gear 36*a* which is engaged with an internal gear ring on gear 29. Gear 29 has two gear rings 29*a*, 29*b* of different pitch, for selective engagement with differently pitched gears 43 (FIG. 1) of the unit 3. The gear 29 is secured to the shaft 36, for example by a square-end connection and an additional C-ring, as well known. Upon removal of the outer C-ring 24*b*, the gear 29 can be reversed, and pinion 28 moved, accordingly, for example by a suitable spacer sleeve 28*a*. Of course, the internal gearing of the gear portions 29*a*, 29*b* will be the same to always engage with the gear 36*a*.

I claim:

1. In combination with a printing-type office machine (3) such as a typewriter, word processor, computer output printer, or the like, having a rotatable platen (42) and a platen gear (43) coupled to the platen and rotating therewith, a single-sheet paper-feeding apparatus (1, 2) to feed single paper sheets, from a stack (5) to the office machine in accordance with selected rotation of the platen, comprising, in accordance with the invention, a sheet-guiding and separating unit (1) and an adapter frame (2) coupling the sheet-feeding unit (1) to the office machine (3);

said sheet guiding and separating unit (1) including a rotation transmitting connecting means (10);

said adapter frame (2) including a shaft (26) positioned essentially parallel to the platen (42) when assembled to the office machine;

a gear (29) rotatably positioned on the frame (2) and arranged for engagement with the platen gear (43);

a coupling pinion (28) secured to the shaft and in rotation-transmitting coupling with said gear (29);

a drive pinion (30) secured to the shaft and transmitting rotary movement in accordance with said coupling pinion (28) to the sheet-guiding and separating unit (1), said drive pinion (30) being located on said shaft for engagement with the connecting means (10) when the sheet guiding and separating unit (1) is coupled to said adapter frame (2);

means (24, 44, 50) for releasably engaging said adapter frame (2) with said office machine;

wherein the connecting means (10) of the sheet-guiding and separating unit are located in radial alignment for engagement with said drive pinion (30) for transmission of rotary movement from the platen via the platen gear (43), said gear (29), said coupling pinion (28) and said shaft (26), while permitting specific matching of a standard sheet-guiding and separating unit (1) to office machines (3) of different types, manufacturing origin, and dimension;

and wherein said apparatus (1, 2) further includes additional separating means (11, 17; 23) for separately and individually releasably coupling said sheet-guiding and separating unit (1) to the adapter frame at a position effecting said radial alignment of the coupling pinion on the adapter frame (2) and the rotation-transmitting means (10) on said sheet-guiding and separating unit (1).

2. Combination according to claim 1, wherein the adapter frame comprises a pair of lateral frame plates (24);

connecting rods (36, 40) connecting said frame plates (24);

and wherein said gear (29) is located outside of the frame plates (24), and said drive pinion (30) is located on the inside of said frame plates, said shaft (26) extending between said frame plates.

3. Combination according to claim 1, wherein the releasable connection means (23) on the sheet-guiding and separating unit (1) comprises a pair of depending flaps (23) formed with U-shaped slots, dimensioned to engage a projecting element (40) on the adapter frame (2) to form a releasable projection-and-recess engagement therewith.

4. Combination according to claim 2, wherein the releasable connection means between the sheet-guiding and separating unit (1) and said adapter frame (2) comprises a pair of depending flaps (23) formed with U-shaped slots dimensioned to engage one (40) of the connecting rods (36, 40) connecting the frame plates (24) of said adapter frame;

and projecting portions (11) formed with U-shaped grooves (17) dimensioned to fit over and partly around the other one (36) of said connecting rods.

5. Combination according to claim 1, further including positive locking means (44, 50) secured to the adapter frame (2) dimensioned to fit over and positively engage at least partly around a platen shaft (45) of said office machine (3).

6. Combination according to claim 2, further including positive locking means (44, 50) secured to the adapter frame (2) dimensioned to fit over and positively engage at least partly around the platen shaft (45) of said office machine (3);

and wherein said frame plates (24) are formed with abutment surfaces (24') fitting against a support surface (3) formed on the office machine (3).

7. Combination according to claim 2, wherein one (36) of said connecting rods is rotatably located between said frame plates (24);

and a drive connection (**36*a*) is provided between said rotatably located rod (36) and said gear (29) to permit conjoint rotation of said shaft (26) and said rod (36) and hence feed of paper sheets removed from the office machine (3), positively, between said at least one roller (32**) and said rod.

8. Combination according claim 1, wherein said gear (29) positioned and dimensioned to engage the platen gear (43) has more than one gear ring (**29*a*, 29*b*) thereon, and is selectively positionably secured to the adapter frame (2) for selective engagement with platen gears (43**) of different construction and gear pitch.

9. Combination according to claim 1, including means (32) for transporting sheets being removed from the office machine (3).

10. Combination according to claim 1, including at least one sheet removal roller (32) located on said shaft (26) and rotating therewith to transport sheets being removed from the office machine (3).

11. Combination according to claim 1, including at least one sheet removal roller (32) rotating with said shaft (26) to transport sheets being removed from the office machine (3).

* * * * *